United States Patent [19]

Curtis et al.

[11] 4,414,935

[45] Nov. 15, 1983

[54] CYLINDER DEACTIVATION DEVICE WITH SLOTTED SLEEVE MECHANISM

[76] Inventors: Nikolaus A. Curtis, 3182 Iron Dr.; Carroll M. Renshaw, 2160 S. 27th Ave., both of Yuma, Ariz. 85364

[21] Appl. No.: 232,878

[22] Filed: Feb. 9, 1981

[51] Int. Cl.[3] ..... F02D 13/06

[52] U.S. Cl. ..... 123/198 F; 123/90.16; 123/90.43

[58] Field of Search ..... 123/198 F, 90.15, 90.16, 123/90.23, 90.32, 90.41, 90.43, 90.47

[56] References Cited

U.S. PATENT DOCUMENTS

| | | | |
|---|---|---|---|
| 4,173,209 | 11/1979 | Jordan | 123/198 F |
| 4,221,199 | 9/1980 | Bunch et al. | 123/198 F |
| 4,221,201 | 9/1980 | Soeters | 123/198 F |
| 4,245,596 | 1/1981 | Binder et al. | 123/198 F |
| 4,249,488 | 2/1981 | Siegla | 123/198 F |

*Primary Examiner*—Ira S. Lazarus
*Attorney, Agent, or Firm*—Cahill, Sutton & Thomas

[57] ABSTRACT

A cylinder deactivation device includes a stud rigidly engaged with the head of an internal combustion engine, a rocker arm, a rocker ball, a stand element attached to the upper end of the stud, a cylindrical sleeve having an inclined slot in the wall thereof, a peg slidably disposed in the inclined slot and extending through a cylindrical hole in the fixed element, and a compression spring for exerting a constant force urging the rocker ball against the rocker arm. The cylindrical sleeve is rotated to control the elevation of the sleeve in order to force the rocker ball to function as a fulcrum for the rocker arm or to allow the rocker ball to yield to the rocker arm. In one embodiment of the invention, the slot is L-shaped.

14 Claims, 16 Drawing Figures

CYLINDER DEACTIVATION DEVICE WITH SLOTTED SLEEVE MECHANISM

BACKGROUND OF THE INVENTION

1. Field of the Invention

The invention relates to devices for selectively deactivating cylinders of internal combustion engines to improve operating economy under low-load operating conditions.

2. Description of the Prior Art

A number of systems for selectively deactivating cylinders of internal combustion engines have been proposed. One such system is disclosed in U.S. Pat. No. 4,168,449, wherein a hydraulically actuated device attached to a stud extending from the head of the engine engages a rocker ball about which the rocker arm pivots during normal engine operation. The normal fulcrum point for the rocker arm is maintained when the hydraulic device is actuated. The hydraulic device includes a piston which forces three rods against the sleeve, the lower end of which engages the rocker ball. When the hydraulic pressure is released, the rocker ball is no longer maintained in fixed relationship to the stud, so that when the push rod forces one end of the rocker arm upward, the rocker ball yields to the rocker arm and does not act as a fulcrum therefore. This prevents the corresponding valve from opening. The device disclosed in U.S. Pat. No. 4,169,449 has numerous shortcomings, one of the most serious of which is that when the engine is operating, there is little or no downward pressure continuously exerted on the push rods for "deactivated" cylinders, while there is a very large downward pressure exerted on by the push rod end of the rocker arms for "activated" or normally operating cylinders (due to the forces exerted on the opposite ends of the rocker arms by the valve springs of open valves.) This imbalance results in "lash" or shock in the timing gears and timing belts that drive the camshaft of the engine. Such shock causes excessively loud engine operating noise, especially in engines which are somewhat worn (due to use). Further, the imbalance and resulting lash or shock substantially decreases the normal life expectancy of timing gears and timing belts causing unexpected failures.

Accordingly, it is an object of the invention to provide a cylinder deactivation system which does not produce substantially increased noise in an operating engine.

It is another object of the invention to provide a cylinder deactivation system which does not result in excessive wear of timing gears or timing belt components in an internal combustion engine.

The above mentioned three rods which engage the hydraulic piston and the above mentioned cylinder deactivation system experience an undue amount of wear. Furthermore, fitting of the system described in U.S. Pat. No. 4,169,449 usually requires "tapping into" the hydraulic system which operates the power steering unit of an automobile, increasing the likelihood of a leak in that system and loss of power steering due to leakage or other malfunction. If the above described cylinder deactivation device is to be retrofitted to an automobile which does not have power steering, a hydraulic fluid pump must be installed, greatly increasing the expense of providing the deactivation system on that automobile.

Furthermore, the deactivation system disclosed in U.S. Pat. No. 4,169,449 causes the deactivable cylinders to be deactivated when the engine is not running because the hydraulic pressure does not exist when the engine is off. This means that only the non-deactivable cylinders can fire during starting of the engine, so an engine using the system of U.S. Pat. No. 4,169,449 experiences difficult starting. Furthermore, if the engine has a tendency to "diesel" when the engine is turned off, this tendency becomes more pronounced, due to the loss of hydraulic pressure that deactivates some of the cylinders thereby reducing the amount of "load" on the dieseling cylinders.

Accordingly, it is another object of the invention to provide a cylinder deactivation system which does not require a hydraulic fluid pump.

The cylinder deactivation system disclosed in U.S. Pat. No. 4,169,449 is unduly complex in that it requires a large number of high precision, expensive components. The complex design results in unduly low reliability and high cost.

Therefore, it is another object of the invention to provide a cylinder deactivation system that requires relatively few components and is inexpensive to manufacture and install in an automobile engine.

A number of other cylinder deactivation systems, including those disclosed in U.S. Pat. Nos. 4,204,512, 4,096,845, 4,141,333, 4,114,588, 4,187,824, and 4,161,938 all have various serious disadvantages which make them unduly expensive, unreliable, and unsuitable for being retrofitted to most previously manufactured automobile engines.

Another cylinder deactivation system, which is available on 1981 Cadillac automobiles, includes an assembly having a solenoid and two movable fulcrum members which rest against rocker pivots. The device is attached to the cylinder head by means of two bolts which respectively pass through the two respective movable fulcrum members, rocker pivots and rocker arms. Compression springs inside each of the movable fulcrum members engage a plate from which four pegs extend upwardly. A slotted disc is rotatably disposed at the upper end of each of the two cylindrical fulcrum members. If the disc is aligned with the pegs, the pegs pass through the slots of the disc, allowing the fulcrum member and rocker pivot to yield to the rocker arm from opening a valve. However, if the pegs and the slots in the disc are not aligned, the movable fulcrum member maintains the rocker pivot in a fixed position, so that when the push rod is raised, the rocker arm pivots about the rocker pivots, causing a valve of the engine to open. The foregoing is not suitable for adaptation to other types of previously manufactured engines because it is completely unadjustable, so that it can not be installed on engine having normal studs. Furthermore, when the subject cylinder is activated, the pegs "hammer" against the rotating discs each time the corresponding push rod is raised. It would appear that this hammering would result in undue engine wear and engine noise.

It is therefore another object of the invention to provide an improved, low cost, highly reliable cylinder deactivation system which avoids the shortcomings of the prior art.

Another object of the invention is to provide a low cost, reliable cylinder deactivation system which is easily installed on prior external combustion engines.

SUMMARY OF THE INVENTION

Briefly described, and in accordance with one embodiment thereof, the invention provides a cylinder deactivation device for installation on internal combustion engines. The cylinder deactivation device includes a rocker arm having first and second end portions and a midportion, a stud mounted in fixed relationship to the head of the engine for supporting the cylinder deactivation device, a selectively movable fulcrum which either assumes a fixed relationship relative to the stud, causing the rocker arm to pivot about the movable fulcrum in a normal manner if the corresponding cylinder is activated, or yielding to movement of the mid portion of the rocker arm, preventing the rocker arm from opening a valve of the engine, if the cylinder is deactivated. In the described embodiments of the invention, a compression spring continually exerts a sufficient amount of force against the movable fulcrum and hence against the mid portion of the rocker arm, to eliminate noise and wear due to imbalance of counterforces on the push rods of activated and deactivated cylinders during engine operation. In one described embodiment of the invention, the movable fulcrum includes a rocker ball and a cylindrical sleeve having an inclined slot in the wall thereof. A fixed stand member attached to the upper end of the stud has a transverse hole therein accommodating a pin that also extends through the inclined slot. The inclined slot has an upper end portion and a lower end portion, so that when the sleeve is rotated in one direction, the pin engages the upper end portion of the inclined slot, maintaining the cylindrical sleeve, and hence the rocker ball in a fixed lowered position thus causing the rocker ball to function as a fulcrum for the rocker arm when the corresponding cylinder is operating in a normal or activated mode. When the cylindrical sleeve is rotated in the opposite direction, the sleeve moves upward, causing the pin to engage the lower portion of the inclined slot as the cylindrical sleeve moves upward. This allows the rocker ball to yield to movement of the mid-portion of the rocker arm, whereby the rocker arm pivots about its valve end, and therefore does not open the valve of the cylinder when the cylinder is deactivated.

In two described embodiments of the invention, actuation devices are provided for applying rotational forces to the cylindrical sleeve to allow selective activation or deactivation of corresponding cylinders of the engine. In one described embodiment of the invention the slot is L-shaped, having a vertical lower portion and a substantially horizontal upper section, and the cylinder sleeve has a bottom flange which engages the bottom of the compression spring, the top of which engages the fixed stand member.

In another described embodiment of the invention, the compression spring is disposed as an overspring surrounding the valve spring of a valve of a cylinder to be deactivated and also engages a flange of the valve end of the rocker arm, instead of being disposed to exert a direct downward force on the midportion of the rocker ball.

In another embodiment of the invention, a modified rocker bar is installed in the engine. The modified rocker ball receives threaded studs on which a cylinder deactivation is installed.

DESCRIPTION OF THE INVENTION

Figure 1:
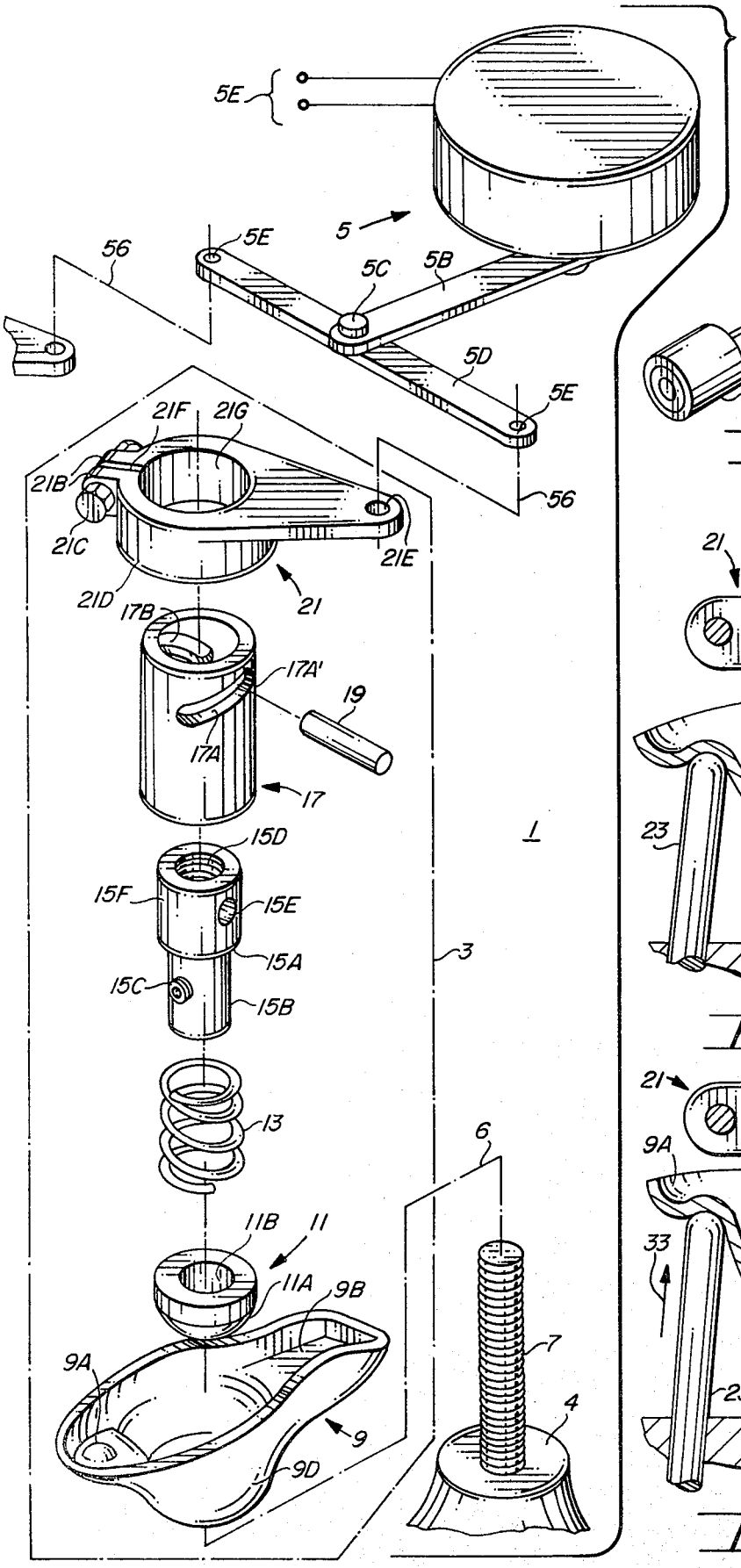
FIG. 1 is an exploded, perspective view of one embodiment of the cylinder deactivation system of the invention.

Referring now to the drawings, and especially to FIG. 1, cylinder deactivation device 1 includes a conventional ball type rocker arm 9 having a hole 9C (FIG. 2A) through which a stud 7 extends. Stud 7 is securely threaded into the head of an internal combustion engine. Reference numeral 4 designates a pedestal of the type employed on certain engine heads. Other engine heads have a flat upper surface with threaded holes into which suitable studs or bolts for the rocker arm assemblies are installed. Dashed line 6 designates the center axis of stud 7 and indicates the center axis of device 1 when the various parts shown in the exploded view of FIG. 1 are assembled.

Rocker arm 9 includes a push rod end 9A that is pushed upward in a conventional fashion by a push rod. Rocker arm 9 also has a valve end 9B which forces the valve stem of a valve 25 (FIG. 2A) downward in a conventional manner. Rocker arm 9 also includes a central pivot section 9D having a rounded interior surface which mates with the rounded lower surface of rocker ball 11. Reference numeral 11A designates the rounded surface (of rocker ball 11) that mates with pivot section 9D of rocker arm 9. Stud 7 extends through a cylindrical hole 11B through rocker ball 11.

A compression spring 13 has a lower end which continually forces rocker ball 11 against pivot section 9D of rocker arm 9. The upper end of compression spring 13 engages a ridge 15A of stand element 16. Stand element 15 includes a cylindrical lower section 15B which extends through the center of compression spring 9. A vertical threaded hole extends through stem element 15, which is threaded onto the upper end of stud 7. A set screw 15C can be used to precisely adjust the position of stem element 15 on stud 7. Alternately, a set screw can be threaded into the top of threaded hole 15D to abut the top of stud 7 in order to establish the proper elevation of stand element 15.

A sleeve 17 has an inside diameter that enables sleeve 17 to slide smoothly over the cylindrical surface of upper section 15F of stand element 15.

Figure 2A:
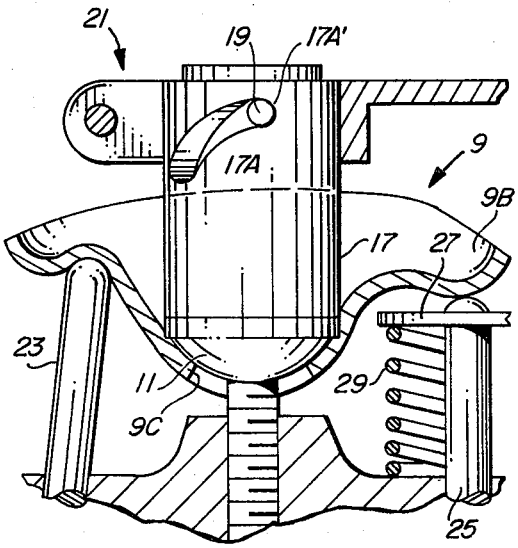
FIG. 2A is a sectional view useful in describing the operation of the cylinder deactivation device of FIG. 1 in an activated cylinder mode.

A pair of inclined slots 17A and 17B are disposed in opposite portions of the cylindral wall of sleeve 17. The upper end portion 17A' of slot 17A is horizontal, as best seen in FIG. 2A. Similarly, the upper end portion of slot 17B is horizontal. Sleeve 17 is disposed over upper section 15F of stand element 15 so that transverse hole 15E in upper portion 15F of stand element is aligned with inclined slots 17A and 17B. A round dowel or pin 19 extends through slots 17A and 17B and transverse hole 15E. Thus, it is easily seen that when sleeve 17 is rotated, sleeve 17 moves vertically up and down relative to stand element 15, stud 7, and cylinder head 4. The bottom edge of sleeve 17 limits upward movement of rocker ball 11, as subsequently explained.

A crank element 21 includes a cylindrical portion 21D having an inside diameter which allows crank element 21D to fit tightly over the upper portion of sleeve 17. The cylindrical wall extends to cover inclined slots 17A and 17B, retaining pin 19 therein. An arm 21A extends from cylinder 21D, and has a hole 21E in its end portion. A pair of ears 21B are attached to the opposite end of cylinder 21D. A gap 21F exists between ears 21C and 21B, extending to hole 21G. A bolt and nut arrangement 21C passes through holes and 21B, allowing crank element 21 to be tightened onto sleeve 17.

A rotary solenoid assembly 5 includes a solenoid body 5A from which two control terminals 5E extend. An arm 5B extends from the rotary shaft of solenoid body 5A. A member 5D is pivotally connected to the outer end of arm 5B by means of pin 5C. A pair of holes 5E are disposed in the opposite ends of member 5D, and are connected as indicated by dashed lines 56 by means of suitable bolts (not shown) to ends of arms 21A of each of two cylinder deactivation devices such as 1.

Figure 2B:
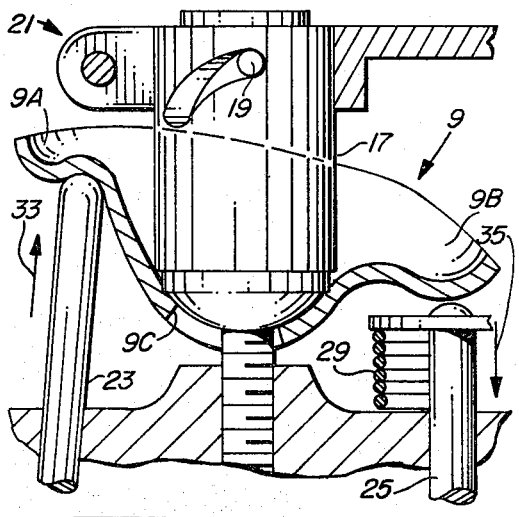
FIG. 2B is another partial sectional view in explaining operation of the device of FIG. 1 in the activated cylinder mode.
Figure 3A:
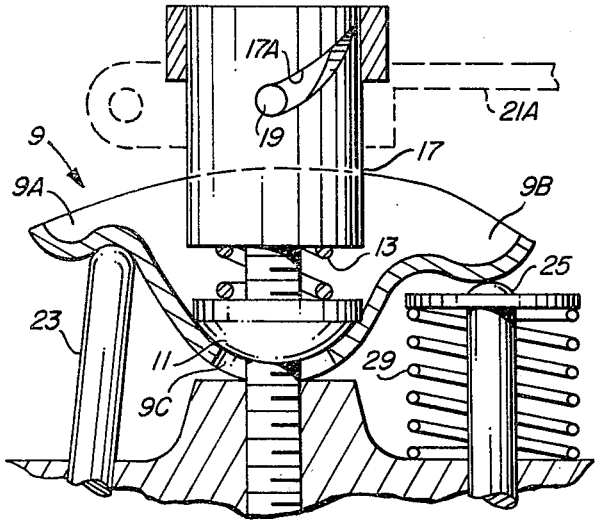
FIG. 3A is a partial section view useful in describing operation of the device of FIG. 1 in the cylinder deactivated mode.
Figure 6:
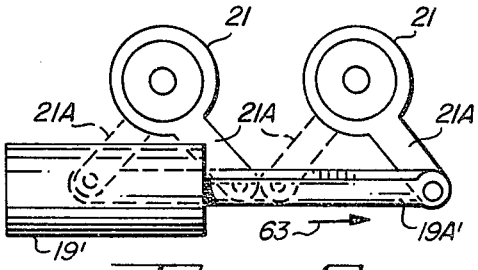
FIG. 6 is a schematic drawing illustrating an alternate solenoid actuation system.
Figure 3B:
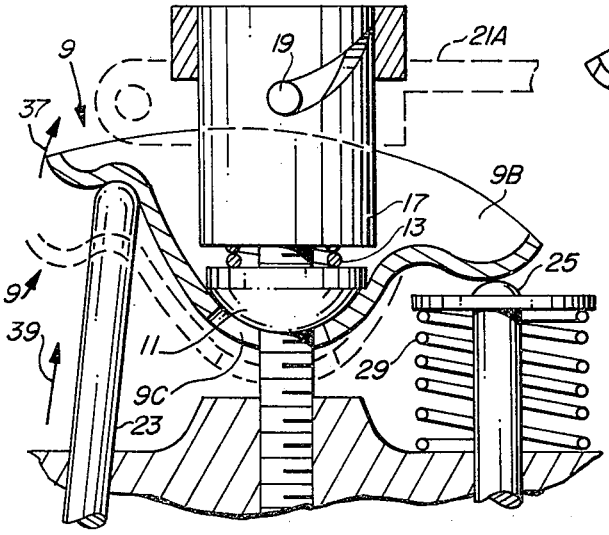
FIG. 3B is another partial section view of the device of FIG. 1 useful in explaining the operation in the cylinder deactivated mode.

The operation of cylinder deactivation device 1 can best be understood with reference to FIGS. 2A, 2B, 3A, and 3B. FIGS. 2A and 2B illustrate the operation of device 1 when the cylinder to which the cylinder deactivation device 1 corresponds is "active" i.e., when the rocker arm assembly operates in the normal fashion to open and close the intake and exhaust valves for that cylinder. FIGS. 3A and 3B illustrate the operation of cylinder deactivation device 1 when the subject cylinder is deactivated, such that its exhaust valve and intake valves remain closed during engine operation. More specifically, when the subject cylinder is deactivated, the fulcrum, i.e., rocker ball 9, is effectively raised so that the exhaust valve and intake valve of that cylinder remain closed during engine operation.

To explain the operation of the device, it is convenient to first assume that the subject cylinder is "active"; therefore rocker arm 9 and valve 25 are operating normally. In this event, crank element 21 is rotated by means of solenoid assembly 5 so that cylinder 17 rotates clockwise (as viewed from the top). When push rod 23 is in its lowered position, as indicated in FIG. 2A, sleeve 17 moves downward due to the inclined orientation of slots 17A and 17B and the forces exerted by pin 19. The upper horizontal end portion 17A' comes to rest when pin 19 is disposed therein. Similarly, the horizontal upper end portion of slot 17B is occupied by the opposite end of pin 19. This causes the lower end of sleeve 17 to abut the upper surface of rocker ball 11. At this point, note that valve 25 is closed.

Now referring to FIG. 2B, assume that push rod 33 moves upward in the direction indicated by arrow 33. The upper end of push rod 23 pushes end 9A of rocker arm 9 upward. The ends of pin 19 in the horizontal upper end portions of slot 17A and 17B prevent sleeve 17 from moving upward as the pivot portion 9D of rocker arm 9 exerts an upward force on rocker ball 11. Rocker ball 11 therefore functions as a fulcrum for rocker arm 9, causing end 9B of rocker arm to move downward, opening valve 25 by pushing the stem thereof downward, as indicated by arrow 35. Thus, it is seen that when sleeve 17 is rotated clockwise by solenoid assembly 5, rocker arm 9 functions normally when the subject cylinder is "active", i.e., not deactivated.

Next, the operation of cylinder deactivation device 1 is described for the case when the subject cylinder is deactivated. In this case, solenoid assembly 5 urges rotation of crank member 21A and sleeve 17 in the counter-clockwise direction. As sleeve 17 rotates counter-clockwise, the force exerted on slots 17A and 17B by pin 19 causes sleeve 17 to move upward until the opposite ends of pin 19 are located in the lower ends of slots 17A and 17B, as shown in FIG. 3A. In FIG. 3A, push rod 23 is in its lowest position. It can be seen that compression spring 13 exerts a downward force on rocker ball 11. Thus, a downward force is exerted upon the pivot portion 9D of rocker arm 9. Meanwhile, valve spring 29 exerts an upwardly force on valve 25, which in turn exerts an upward force on end 9B of rocker arm 9. The upward force exerted on valve 25 by valve spring 29 is much greater that the downward force exerted on rocker ball 11 by compression spring 13. Thus, valve 25 remains closed due to the upward force exerted by valve spring 29 on valve 25. For many engines, the downward force exerted on rocker ball 11 by compression spring 13 is preferably at least approximately 39 pounds, as subsequently explained. (Thus, it is seen that the function of compression spring 13 is to cause a continuous, minimum downward force to be exerted by end 9A of rocker arm 9 on push rod 23. This has been found to eliminate the noise and accelerated wear on the timing gear and timing chains caused the above-mentioned imbalance of forces on the cam shaft when the engine is operating with cylinders deactivated.)

Still referring to FIG. 3B, the configuration of cylinder deactivation device 1 is shown for the condition that push rod 23 is moved upward, as indicated by arrow 39, from its lowest position (as shown in FIG. 3A) to its highest position. Since valve spring 29 is much stronger than compression spring 13 and since the lower end of sleeve 17 no longer limits upward movement of rocker ball 11, the center portion 9D of rocker arm 9 moves upward, forcing rocker ball upward, compressing compression spring 13. Meanwhile, end 9B of rocker arm 9 remains at the same elevation shown in FIG. 3A, because valve spring 29 does not become compressed, since it is weaker than compression spring 13. Thus, valve 25 remains closed during engine operation, and the subject cylinder is referred to as being "deactivated". Since the valve remains closed, no fuel is drawn into that cylinder, no combustion takes place therein, and fuel economy of the engine is increased under low load conditions.

Ordinarily, for a conventional V-8 automobile engine of the type commonly installed in American built automobiles and others for many years, the cylinder deactivation device 1 would be installed to selectively deactivate either two or four cylinders. Although variations in the arrangement shown in FIG. 1 are required for difference, the arrangement shown in FIG. 1 will fit a large number of American built engines simply by removing the nut retaining rocker ball 11 on a stud. The stud bolt then is removed, and is replaced by a longer stud bolt. The portion of the assembly 1 including the elements shown above rocker ball 11 in FIG. 1 is then installed on the new stud. The elevation of stand element 15 is precisely positioned so that rocker ball 11 is correctly positioned when the ends of pin 19 are located in the upper horizontal portions of slots 17A and 17B. Two cylinder deactivation devices (one for the intake valve and one for the exhaust valve) are intalled for each cylinder to be deactivated, a single solenoid assembly, such as 5, being used to actuate the cylinder deactivation devices.

Figure 5:
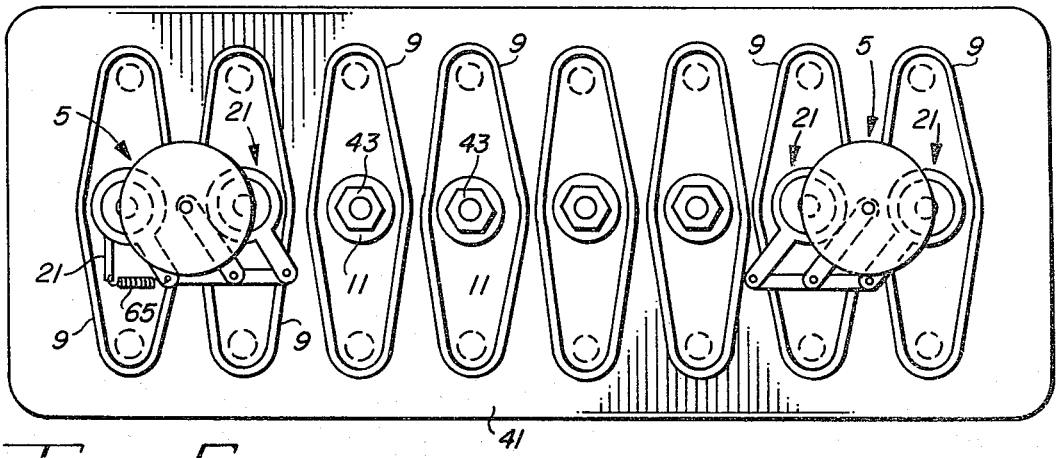
FIG. 5 is a schematic top view diagram of one head of a V-8 engine having two cylinders which are selectively deactivatable.

FIG. 5 shows a schematic top view of the head of one bank of cylinders of a typical V-8 engine, showing four cylinder deactivation devices 1' installed thereon, two of the cylinder deactivation devices being installed for the respective intake and exhaust valves of the two outer cylinders of that bank.

Typically, the solenoid 5A can be a "4B" type rotary solenoid with a bobbin coil, of the type manufactured by LEDEX Corporation of Dayton, Ohio. This type of solenoid exerts a rotary force in one direction only. A simple return spring, schematically indicated by reference number 65 in FIG. 5, can be utilized to return any unactivated solenoid to its initial configuration. For the described embodiment of the invention, the torque of the actuated solenoid is utilized to return crank element 21 in the direction which causes the subject cylinder to be activated.

In order to decrease the current applied to the solenoids to maintain the cylinder activation devices 1 in the deactivated cylinder mode, a holding voltage of 6.6 volts is applied thereto, causing the holding torque to be approximately two inch-pounds. Initially, to quickly accomplish the transition from the activated cylinder mode to the deactivated cylinder mode, twelve volts are applied to the terminals 5E of solenoid 5A, resulting in a torque of approximately 3.1 inch-pounds. The configuration shown in FIG. 1 requires a ninety degree rotary solenoid to accomplish the necessary rotation of cylinder 17 to switch between operation modes.

Figure 4:
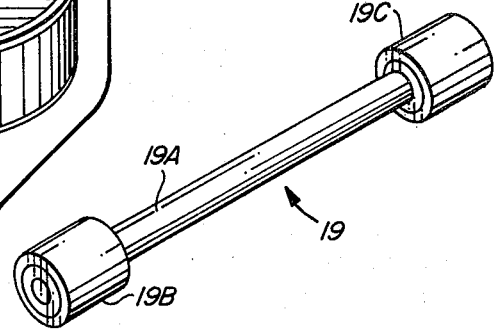
FIG. 4 is a perspective view of an alternate retaining pin arrangement which can be used in the device of FIG. 1.

FIG. 4 shows a modified pin 19 having rollers 19B and 19C on its opposed ends to reduce wear on pin 19 and inclined slots 17A and 17B.

Figure 7:
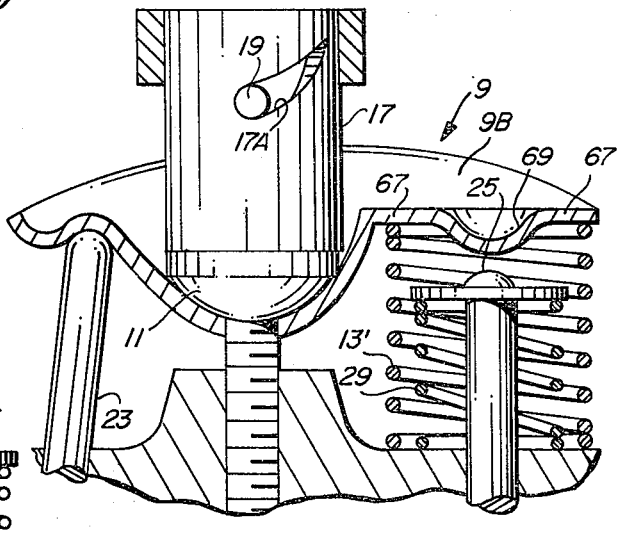
FIG. 7 is a partial perspective view illustrating an alternate embodiment of the invention.

Referring now to FIG. 7, an alternate embodiment of the invention is shown wherein compression spring 13 is omitted. Instead, a compression "overspring" 13' surrounding valve spring 29 is provided. End 9B of rocker arm 9 is provided with a larger flange 67 which engages the upper end of compression overspring 13'; the lower end of compression overspring 13' engages the cylinder head. A dimple 69 is provided on end 9B of rocker arm 9, if desired, to engage the upper end of the stem of valve 25.

When the corresponding cylinder is deactivated, compression overspring 13' maintains a continuous downward force on push rod 23, the force being sufficient to prevent the above mentioned timing gear lash and timing chain lash. When pin 19 is in the lower portion of inclined slot 17A, rocker ball 11 is at its highest position, so that when push rod 23 is at its highest position, end 9B of rocker arm 9 moves downward, partially compressing compression overspring 13', but does not engage the stem of valve 25. Valve 25 therefore remains closed and the cylinder is deactivated.

However, if pin 19 is in the upper horizontal portion 17A' (FIG. 2A) of inclined slot 17A, then rocker ball 11 is at its lowest position, so when push rod 23 moves to its highest position, valve end 9B of rocker arm 9 engages the stem of valve 25, thereby opening valve 25 of the corresponding cylinder, causing it to be activated.

An alternate embodiment of the invention is shown in FIGS. 8, 9A, 9B and 10C; referring to these figures, it is seen that stud 7, rocker arm 9, and rocker ball 11, pin 19, and stand element 15 are essentially the same as for the previously described embodiment of the invention. However, sleeve 17 has been modified to provide two L-shaped slots 17A and 17B, instead of the inclined slots shown in the embodiment of FIG. 1. Also, sleeve 17 now includes a bottom flange 73. The bottom end portion of compression spring 13 now is retained by flange 73 and does not contact the upper surface of rocker ball 11. The upper end of compression spring 13 is retained by the ridge 15A between upper portion 15F and lower portion 15B of stand 15. Thus, compression spring 13 continuously forces the bottom of sleeve 17 downward against the upper surface of rocker ball 11. Pin 19 passes through both of L-shaped slots 17A and 17B and also transverse hole 15E of stand 15.

Figure 8:
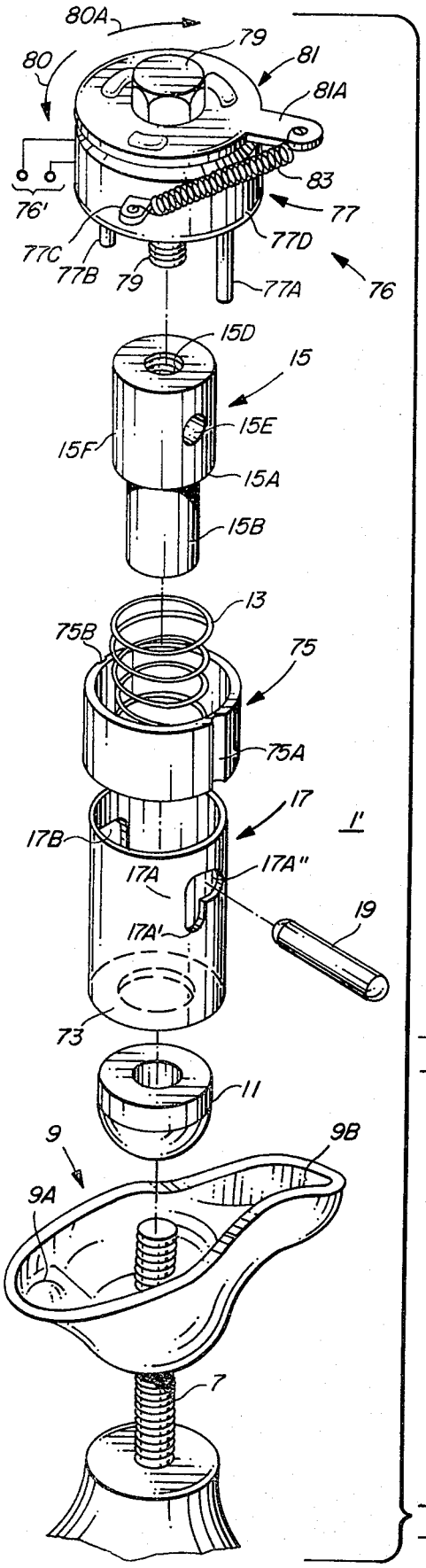
FIG. 8 is an exploded, perspective view of an alternate embodiment of the invention.
Figure 9A:
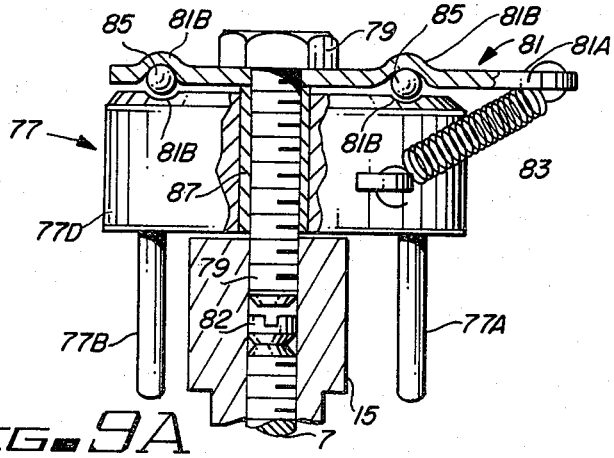
FIG. 9A is a partial section to be useful in explaining the operation of the embodiment of FIG. 8.

A modified rotary solenoid assembly 76 is shown in FIG. 8. Solenoid assembly 76 includes a solenoid having a body 77 and an armature plate 81. As best seen in FIG. 9A, which is a partial sectional view of solenoid assembly 76, armature plate 81 rigidly engages the top of stand 15 by means of shoulder bolt 79 and by means of a sleeve or collar 87. (Note that in FIG. 9A, reference number 82 designates a set screw threaded into hole 15D of stand element 15. Set screw 82 serves as a stop for stud 7, and is precisely positioned to ensure that precisely the proper elevation of stand element 15 is achieved such that rocker arm 9 properly operates in conjunction with push rod 23 and valve 25.)

Thus, it is seen that armature plate 81 is stationary, due to its rigid connection to stand element 15. Body 77D of rotary solenoid 77 (which can be implemented by means of any of a number of suitable solenoids, such as one identified by Code No. 818, sold by LEDEX, Inc., Dayton, Ohio) rotates when power is applied to terminals 76' (FIG. 8). When rotary solenoid 77 is actuated, body 77D rotates in a direction indicated by arrow 80. When power is disconnected, body 77D is rotated back to its initial position, in the direction indicated by arrow 80A, by return spring 83, which is connected between the end of arm 81A of armature plate 81 and tab 77C which is attached to the body 77D of rotary solenoid 77.

The operation of rotary solenoid 77 will be better understood with reference to FIG. 9A, when it is realized that steel balls 85 are disposed in sloped races 81B, so that when power is applied to terminals 76' (FIG. 8), a very powerful electromagnetic force tends to pull armature plate 81 towards body 77D. Steel balls 85 roll in the sloped races 81B, thereby producing rotation of body 77D, relative to stationary armature plate 81, causing pegs 77A and 77B to rotate.

Pegs 77A and 77B are rigidly attached to the bottom of body 77D, and respectively engage vertical slots 75A and 75B of collar 75. Collar 75 is pressed over the upper portion of sleeve 17, providing a tight fit thereto and covering at least a portion of L-shaped slots 17A and 17B. Thus, when body 77D of rotary solenoid 77 rotates, sleeve 17 also rotates.

Figure 10:
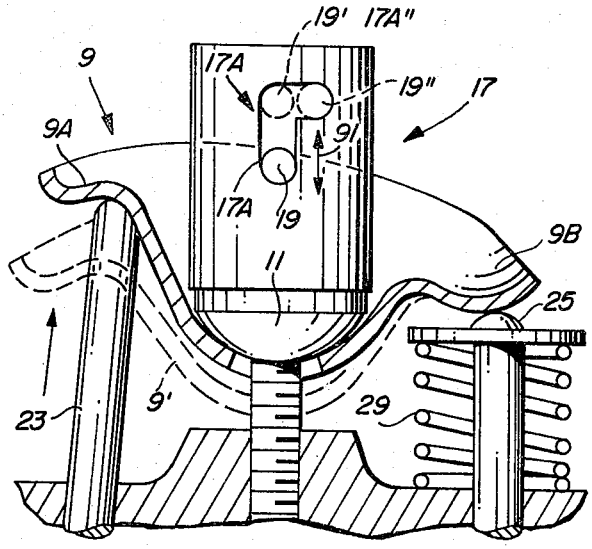
FIG. 10 is a partial sectional diagram useful in explaining the operation of the embodiment of FIG. 8.

The operation of the embodiment of the invention shown in FIG. 8 can be further understood by reference to FIG. 10. The basic principals of operation of the embodiment of FIG. 8 are entirely similar to those of the previously described embodiment of the invention. Note, however, that compression spring 13 always maintains a continuous downward force on bottom flange 73 of sleeve 17, as previously mentioned. When the engine is operating in a mode such that cylinder corresponding to device 1' of FIG. 8 is active, sleeve 17 is rotated so that pin 19 is in the position indicated by dotted lines 19'. The horizontal upper portion 17A" of L-shaped slot 17A prevents sleeve 17 from moving vertically. Sleeve 17 therefore maintains rocker ball 11 at its lowest position, so that rocker arm 9 repeatedly pivots about rocker ball 11 in response to upper movement of push rod 23, thereby opening and closing valve 25 for normal operation of the cylinder.

However, when the cylinder is inactive, body 77D of rotary solenoid 77 rotates so that the vertical portion of L-shaped slot 17A is aligned with pin 19 as push rod 23 rises and falls during engine operation. When a rotational force, in the direction indicated by arrow 80A, is applied to sleeve 17, sleeve 17 will rotate in a clockwise direction (as viewed from the top) when sleeve 17 moves to its lowest position, so that pin 19 is aligned with the horizontal upper portion of L-shaped slot 17A. (Note that only approximately 15 degrees of rotation of sleeve 17 is required to cause the upper right end portion of 17A" of L-shaped slot 17A to be occupied by pin 19 in order to switch the subject cylinder from the deactivated to the active mode. The amount of time required to perform this switching operation is therefore less for the embodiment of FIG. 8 than for the embodiment of FIG. 1, since the torgue of the rotary solenoid needs to overcome less inertia in order to accomplish the needed rotation.)

Then, sleeve 17 moves repeatedly up and down in the directions indicated by arrow 91. Rocker ball 11 therefore also moves up and down in the directions indicated by arrow 91. Thus, rocker arm 9 pivots about end 9B thereof, so that valve 25 remains closed when the cylinder is deactivated. In FIG. 10, note that dotted line 9' indicates the lowest position of rocker arm 9 during operation of the cylinder in the deactivated mode, while the solid line indicates the highest position of rocker arm 9 when the cylinder is operating normally.

Figure 9B:
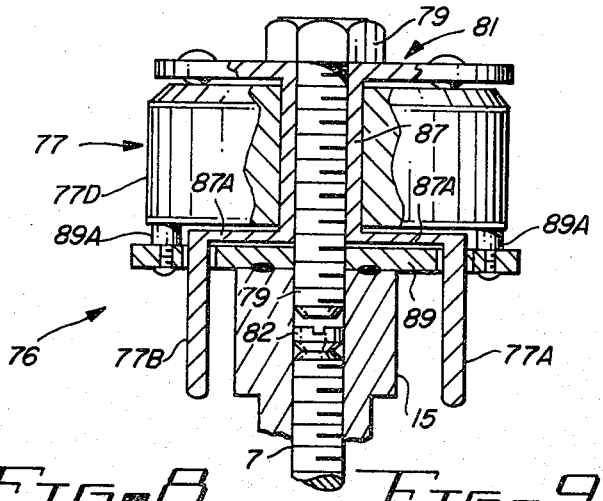
FIG. 9 is a partial sectional view of an alternate cylinder deactivation assembly which can be utilized in conjunction with the embodiment of FIG. 8.

FIG. 9B discloses an alternate arrangement for solenoid assembly 76, wherein pegs 77A and 77B are rigidly connected, relative to armature plate 81, which rotates in response to application of an electrical energy to terminals 76'. Body 77D remains stationary, and is attached by means of bolts or other suitable means to a plate 89. Plate 89 is rigidly attached to the top of stand 15. Standoffs 89A provide clearance for horizontal members 87A which connect sleeve 87 to the tops of pegs 77A and 77B.

Figure 11A:
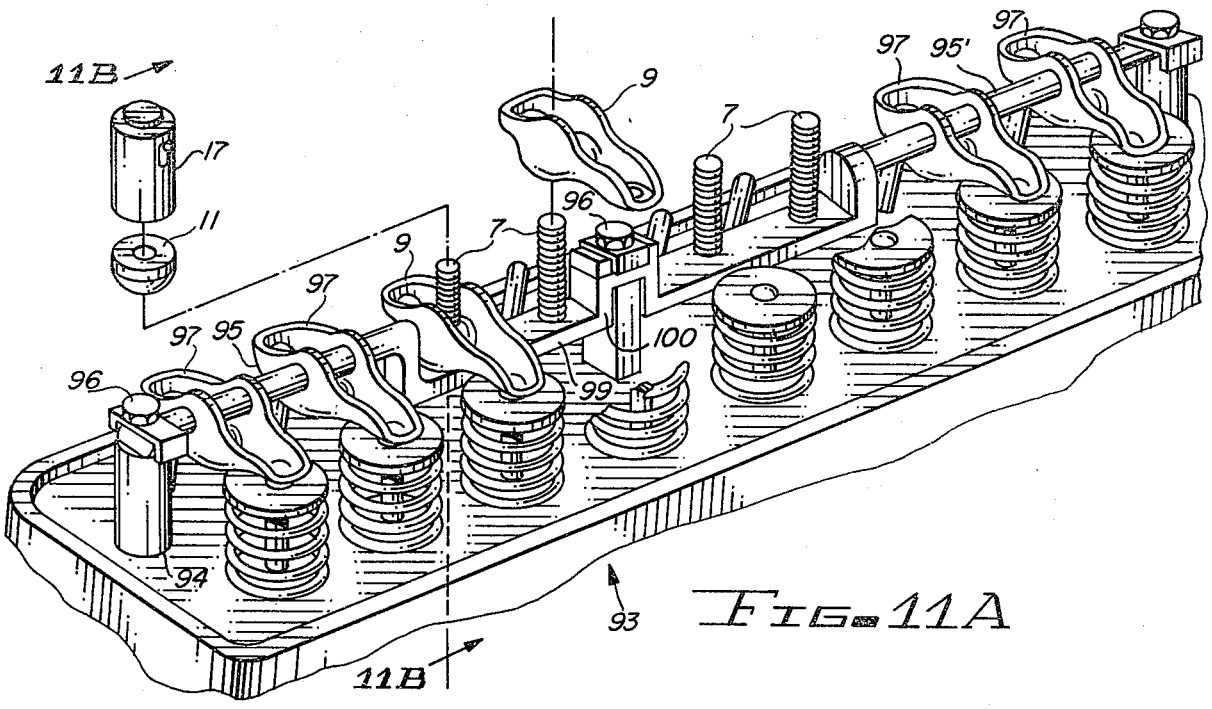
FIG. 11A is a partial perspective view illustrating another embodiment of the invention.
Figure 11B:
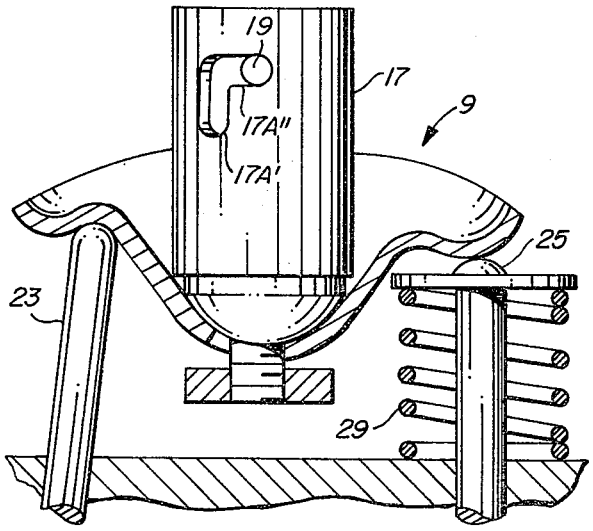
FIG. 11B is a partial sectional view diagram illustrating the operation of the embodiment of FIG. 11A.
Figure 11C:
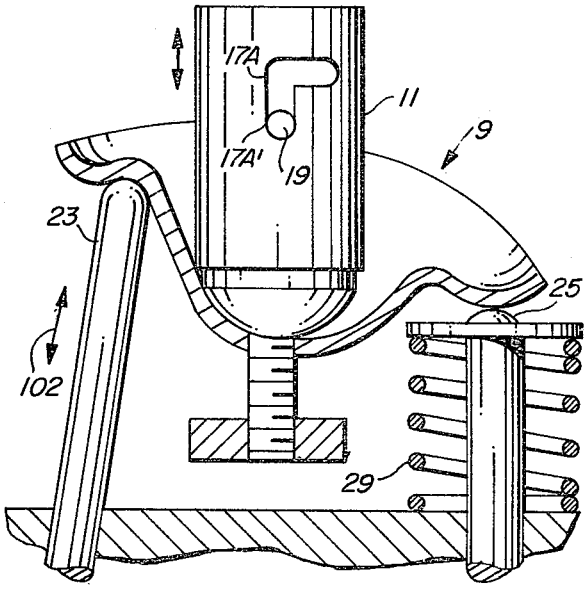
FIG. 11C is another partial sectional view useful in illustrating the operation of the embodiment of FIG. 11A.

Referring now to FIG. 11, another embodiment of the invention is shown, wherein either the assemblies of FIG. 1 or 8 are installed in an engine in which the rocker arms 97 pivot about a rocker bar instead of rocker balls such as 11 of FIG. 1. Installation of the cylinder deactivation mechanisms of the present invention is accomplished in such engines by providing a modified rocker bar which includes a horizontal, flat plate 99 rigidly held in a lowered position relative to the position of main rocker bar 95 by means of two vertical elements 98 and 100. Support plate 99 receives two studs 7, which are similar to those designated by that reference numeral in FIGS. 1 and 8. The ball type rocker arms 9 previously shown in FIGS. 1 and 8 are then utilized in the place of the original rocker arms 97 for the cylinder which is to be deactivated. Either the assembly of FIG. 1 or FIG. 8 then can be installed on the upper portion of studs 7. The modified rocker bar can be installed by means of bolt 96 on the stands 94 originally provided in the engine.

In FIG. 11A and 11B, operation of the assembly of FIG. 8 installed on the modified rocker bar of FIG. 10 is illustrated, but will not be described in detail, since operation of the assembly of FIG. 8 has already been previously described.

While the invention has been described with reference to several particular embodiments thereof, those skilled in the art will be able to make numerous modifications to the disclosed structures without departing from the true spirit and scope of the invention.

I claim:

1. A cylinder deactivation device for installation on an internal combustion engine, said cylinder deactivation device comprising in combination:

a. rocker arm means for effecting opening a valve of said engine, said rocker arm means having a first end portion, a second end portion, and a mid portion disposed between said first end portion and said second end portion;

b. support means connected in fixed relationship with a head of said engine for supporting said cylinder deactivation device;

c. stand means for engaging said support means in an adjustable fixed relation thereto;

d. movable fulcrum means for selectively either, i. assuming a first fixed relationship to said stand means to engage said mid portion and cause said rocker arm means to pivot about said mid-portion during operation of said engine, thereby causing a valve of said engine to open and close during operation of said engine, or ii. yielding to movement of said mid portion to cause said rocker arm means to pivot about said second end portion during engine operation, said first end portion moving in response to a cam during engine operation, said second end portion engaging said valve, said valve remaining closed during said pivoting about said second end portion, said movable fulcrum means including a movable sleeve disposed about said stand means;

e. selective engagement means disposed within said movable sleeve for selectively either i. engaging both said movable sleeve and said stand means to cause said movable sleeve to assume said first fixed relationship to said fixed means, or ii. releasing said movable sleeve from said first fixed relationship to allow said movable sleeve to yield to said movement of said mid portion; and f. compression means for continuously exerting substantial opposed forces on said stand means and and said movable fulcrum means to urge said movable fulcrum means against said mid portion, wherein said movable fulcrum means includes a slot and said stand means includes a hole, a pin extending into both said hole and said slot to keep said slot aligned with said hole.

2. The cylinder deactivation device of claim 1 wherein said support means includes a threaded stud, said stand means including a threaded hole receiving one end of said threaded stud.

3. The cylinder deactivation device of claim 2 wherein said support means includes means, connected to a portion of a rocker bar, for receiving another end of said threaded stud.

4. The cylinder deactivation device of claim 2 wherein a cylinder head of said engine includes a threaded hole for receiving another end of said threaded stud.

5. The cylinder deactivation device of claim 2 wherein said slot is partially inclined, an upper portion of said slot being substantially horizontal relative to an axis of said stud.

6. The cylinder deactivation device of claim 2 wherein said slot is substantially L-shaped, and includes a substantially horizontal portion and a substantially vertical portion, relative to an axis of said stud.

7. The cylinder deactivation device of claim 2 wherein said movable fulcrum means includes a rocker ball and said selective engagement means includes a cylinder surrounding said stand means and slideably movable along said stand means, said slot being disposed in said cylinder.

8. The cylinder deactivation device of claim 7 including two opposed slots in said cylinder, said pin extending into both of said slots.

9. The cylinder deactivating device of claim 8 wherein said compression means includes a spring, and said cylinder includes means for retaining one end of said spring, said stand means retaining another end of said spring.

10. The cylinder deactivating device of claim 1 wherein said substantial force is sufficiently great to substantially eliminate excess engine noise and wear due to imbalance between forces produced on a camshaft of said engine as a result of operating some cylinders of said engine in a deactivated mode wherein said movable fulcrum means assumes said first fixed relationship.

11. The cylinder deactivation device of claim 1 further including motive means for selectively applying forces to said selective engagement means to effect said engaging and said releasing of said movable fulcrum means.

12. The cylinder deactivation device of claims 7 or 11 wherein said motive means includes a rotary solenoid and means for translating rotation of an element of said rotary solenoid to said cylinder.

13. The cylinder deactivation device of claim 12 wherein said motive means includes a return spring connected to said rotary solenoid to effect returning of said element of said rotary solenoid to an initial positón when said rotary solenoid is de-energized.

14. A cylinder deactivation device for installation on an internal combustion engine, said cylinder deactivation device comprising in combination:

a. a rocker arm means for effecting opening a valve of said engine, said rocker arm means having a first end portion, a second end portion, and a mid portion disposed between said first end portion and said second end portion;

b. support means connected in fixed relationship with a head of said engine for supporting said cylinder deactivation device;

c. stand means for engaging said support means in an adjustable fixed relation thereto;

d. movable fulcrum means for selectively either, i. assuming a first fixed relationship to said stand means to engage said mid portion and cause said rocker arm means to pivot about said mid-portion during operation of said engine, thereby causing a valve of said engine to open and close during operation of said engine, or ii. yielding to movement of said mid portion to cause said rocker arm means to pivot about said second end portion during engine operation, said first end portion moving in response to a cam during engine operation, said second end portion engaging said valve, said valve remaining closed during said pivoting about said second end portion, said movable fulcrum means including a movable sleeve disposed about said stand means;

e. selective engagement means disposed within said movable sleeve for selectively either i. engaging both said movable sleeve and said stand means to cause said movable sleeve to assume said first fixed relationship to said fixed means, or ii. releasing said movable sleeve from said first fixed relationship to allow said movable sleeve to yield to said movement of said mid portion; and f. compression means for continuously exerting substantial opposed forces on said stand means and said movable fulcrum means to urge said movable fulcrum means against said mid portion, wherein said compression means includes an overspring disposed around a valve spring of said engine for exerting a force against said second end portion of said rocker arm means, said second end portion having a flange for engaging one end of said overspring.

* * * * *